US009222700B2

(12) United States Patent
Muller et al.

(10) Patent No.: US 9,222,700 B2
(45) Date of Patent: Dec. 29, 2015

(54) METHOD AND DEVICE FOR BLOWING GAS ON A RUNNING STRIP

(71) Applicants: Jerome Muller, Courcelles Chaussy (FR); Akli Elias, Metz (FR); Thierry Petesch, Hayange (FR); Ivan Santi, Auboue (FR); Paul Durighello, Thionville (FR); Karen Beaujard, Metz (FR)

(72) Inventors: Jerome Muller, Courcelles Chaussy (FR); Akli Elias, Metz (FR); Thierry Petesch, Hayange (FR); Ivan Santi, Auboue (FR); Paul Durighello, Thionville (FR); Karen Beaujard, Metz (FR)

(73) Assignee: ArcelorMittal France, Saint Denis (FR)

( * ) Notice: Subject to any disclaimer, the term of this patent is extended or adjusted under 35 U.S.C. 154(b) by 158 days.

(21) Appl. No.: 14/058,750

(22) Filed: Oct. 21, 2013

(65) Prior Publication Data

US 2014/0047729 A1 Feb. 20, 2014

Related U.S. Application Data

(62) Division of application No. 12/594,773, filed as application No. PCT/FR2008/051895 on Oct. 21, 2008, now Pat. No. 8,591,675.

(30) Foreign Application Priority Data

Mar. 14, 2008 (EP) ..... 08300145

(51) Int. Cl.
*F26B 7/00* (2006.01)
*F24H 9/00* (2006.01)
(Continued)

(52) U.S. Cl.
CPC ..... *F24H 9/00* (2013.01); *B21B 45/004* (2013.01); *B21B 45/0209* (2013.01);
(Continued)

(58) Field of Classification Search
CPC ..... B21B 45/0218; B21B 45/004
USPC ..... 266/103, 114
See application file for complete search history.

(56) References Cited

U.S. PATENT DOCUMENTS 4,448,614 A 5/1984 Morimoto et al.
5,871,686 A 2/1999 Nivoche
(Continued)

FOREIGN PATENT DOCUMENTS

EP 0 761 829 A1 3/1997
EP 1 067 204 A1 1/2001
(Continued)

OTHER PUBLICATIONS

English Language translation of JP 2004-269930 A Sep. 2004.

*Primary Examiner* — Scott Kastler
(74) *Attorney, Agent, or Firm* — Sughrue Mion, PLLC

(57) ABSTRACT

The present invention relates to a method for acting on the temperature of a travelling strip (4) by blowing gas or a water/gas mixture, whereby a plurality of jets of gas or a water/gas mixture, extending toward the surface of the strip and arranged in such a way that the impacts (24, 34) of the jets of gas or water/gas mixture on each surface of the strip are distributed at the nodes of a two-dimensional network, are sprayed onto each face of the strip. The impacts (24) of the jets on one face (A) are not opposite the impacts (34) of the jets on the other face (B), and the jets of gas or water/gas mixture come from tubular nozzles (23, 33) which are supplied by at least one distribution chamber (21, 31) and extend at a distance from the distribution chamber in such a way as to leave a free space for the flow of the returning gas or water/gas mixture parallel to the longitudinal direction of the strip and perpendicular to the longitudinal direction of the strip.

19 Claims, 9 Drawing Sheets

(51) Int. Cl.

| | |
|---|---|
| ***B21B 45/00*** | (2006.01) |
| ***B21B 45/02*** | (2006.01) |
| ***C21D 1/667*** | (2006.01) |
| ***C21D 9/52*** | (2006.01) |
| ***C21D 9/573*** | (2006.01) |
| *B21B 15/00* | (2006.01) |

(52) U.S. Cl.
CPC ..... *B21B 45/0218* (2013.01); *C21D 1/667* (2013.01); *C21D 9/52* (2013.01); *C21D 9/573* (2013.01); *B21B 15/005* (2013.01); *B21B 45/0215* (2013.01); *B21B 45/0233* (2013.01); *B21B 2045/0212* (2013.01)

(56) References Cited

U.S. PATENT DOCUMENTS

| | | | | |
|---|---|---|---|---|
| 5,885,382 | A | 3/1999 | Sakurai et al. | |
| 6,309,483 | B1 | 10/2001 | Wang et al. | |
| 2006/0060271 | A1 | 3/2006 | Fujibayashi et al. | |
| 2007/0241485 | A1 | 10/2007 | Boyer et al. | |
| 2010/0269367 | A1 * | 10/2010 | Langevin et al. | 34/611 |

FOREIGN PATENT DOCUMENTS

| | | | |
|---|---|---|---|
| EP | 1 527 829 | A1 | 5/2005 |
| EP | 1 935 522 | A1 | 6/2008 |
| EP | 2085488 | A1 * | 8/2009 |
| FR | 2 876 710 | A1 | 4/2006 |
| JP | 7-234070 | A | 9/1995 |
| JP | 11-285723 | A | 10/1999 |
| JP | 2004-269930 | A | 9/2004 |
| JP | 2006-205225 | A | 8/2006 |
| WO | 2007/026906 | A1 | 8/2006 |
| WO | 2007/055403 | A1 | 5/2007 |

* cited by examiner

METHOD AND DEVICE FOR BLOWING GAS ON A RUNNING STRIP

CROSS REFERENCE TO RELATED APPLICATIONS

This application is a divisional of U.S. application Ser. No. 12/594,773, filed Mar. 25, 2010, now U.S. Pat. No. 8,591,675, which is a National Stage of International Application No. PCT/FR2008/051895, filed on Oct. 21, 2008, which claims priority from European Patent Application No. 08300145.3, filed Mar. 14, 2008, the contents of all of which are incorporated herein by reference in their entirety.

The present invention relates to the blowing of gas or a water/gas mixture onto a travelling strip in order to act on the temperature thereof so as to cool or heat it.

Cooling chambers are arranged at the outlet of some installations for treating travelling metal strips, and the strips travel vertically in the chambers between two gas-blowing modules for cooling the strip, it being possible for the gas to be air, an inert gas, or a mixture of inert gases.

In general, blowing modules consist of distribution chambers supplied with pressurised gas, each chamber comprising a face provided with openings which constitute nozzles, arranged opposite one another on either side of a blowing zone through which a travelling strip passes.

The openings may either be slots extending over the entire length of the strip, or point-like openings arranged in a two-dimensional network to distribute the gas jets over a surface extending over the width and a particular length of the zone of travel of the strip. To balance the effects of the jets generated by each of the blowing modules arranged opposite one another, the modules are set in such a way that the jets from one module are opposite the jets of the other module.

It has been found that the blowing of gas induces vibrations of the travelling strip, leading to distortion and lateral displacements of the strip from one blowing module to the other, opposing blowing module. The distortions are produced in that the strip is twisted about an axis which is generally parallel to the direction of travel of the strip. The lateral displacements are brought about by displacement of the strip in a direction perpendicular to the central plane of the zone of travel of the strip, which is generally parallel to the surface of the strip.

These vibrations become more significant as the intensity of the blowing is increased. This means that the intensity of the blowing, and thus of the cooling, must be limited in order to avoid excessive vibrations, which might cause damage to the strips.

To overcome this drawback, it has been proposed that the blowing chambers be shortened in such a way that a plurality of chambers, separated by means for holding the strip such as rollers or aeraulic stabilisation means, are provided. However, these devices have the drawback that they either require stabilisers to be in contact with the strip, which is unsuitable for some applications such as cooling at the outlet of hot galvanising, or require particular cooling in the poorly controlled aeraulic stabilisation regions.

It has also been proposed that the strip be stabilised by acting on the tension applied to the strip, in particular by increasing it. However, this method has the drawback of producing substantial stresses in the strip, which can have an adverse effect on its properties.

Attempts have also been made to reduce the vibrations of the strip by acting on the blowing speeds or the distances between the heads of the nozzles and the strip or the blow rate.

However, all these methods result in a decrease in the effectiveness of the cooling and thus in the performance of the installation.

Lastly, devices have been proposed in which a plurality of nozzles are supplied by distribution chambers, the nozzles being tubes which extend towards the surface of the strip to be cooled, the tubes being inclined perpendicularly to the surface of the strip, the inclination of the tubes being greater the further they are from the centreline of the zone of travel of a strip. In this device, the nozzles are arranged in two-dimensional networks in such a way that the impact points of the gas jets on each face of the strip are opposite one another. This device has the drawback in particular of inducing vibrations of the strip, which make it necessary to limit the blowing pressure and thus the effectiveness of the cooling.

The object of the present invention is to overcome these drawbacks by proposing a means for acting on the temperature of a travelling strip by blowing a gas, which induces limited vibrations of the strip in the passage through the cooling or heating region when it travels through the cooling or heating region, even at high blowing pressures.

The invention accordingly relates to a method for acting on the temperature of a travelling strip by blowing gas, whereby a plurality of jets of gas, extending in the direction of the surface of the strip and arranged in such a way that the impacts of the jets of gas on each surface of the strip are distributed at the nodes of a two-dimensional network, are sprayed onto each face of the strip. The impacts of the jets on one face of the strip are not opposite the impacts of the jets on the other face, and the jets of gas come from tubular nozzles which are supplied by at least one distribution chamber and the heads of which extend at a distance from the distribution chamber so as to leave a free space for the flow of the returning gas parallel to the longitudinal direction of the strip and perpendicular to the longitudinal direction of the strip.

The jets of gas may be perpendicular to the surface of the strip.

The axis of at least one jet of gas may form an angle with the normal to the surface of the strip.

Preferably, the two-dimensional distribution networks of the jet impacts on each of the faces of the strip are periodic, are of the same type and have the same pitch.

The networks are, for example, of the hexagonal type.

More preferably, the impacts of the jets on a single face of the strip are distributed at the nodes of the two-dimensional network so as to form a complex polygonal mesh with a number of sides of between 3 and 20, with a periodicity equal to 1 pitch in the transverse direction of the strip and between 3 and 20 pitches in the longitudinal direction of the strip, in such a way that adjacent impact traces of the blow-jets for one face of the strip are contiguous in the transverse direction of said strip. It will be noted that the contiguous nature of the traces of blow-jets means that the traces may also overlap.

Preferably, the network corresponding to one face and the network corresponding to the other face are offset from one another, and the offset is between ¼ of a pitch and ¾ of a pitch.

The gas may be a cooling gas, a water/gas mixture, or even a hot gas, in particular a combustion gas from a burner.

Advantageously, the length of the nozzles is between 20 and 200 mm.

The invention also relates to a device comprising at least two blowing modules arranged opposite one another on either side of the zone of travel of a strip, each blowing module consisting of a plurality of tubular nozzles extending from at least one distribution chamber in the direction of the zone of travel of the strip, the nozzles being arranged in such a way that the impacts of the jets on each face of the strip are distributed at the nodes of a two-dimensional network, and the blowing modules are set in such a way that the jet impacts on one face are not opposite the jet impacts on the other face.

Preferably, the two-dimensional networks in which the jet impacts are distributed are periodic networks of the same type and with the same pitch.

The networks may be of the hexagonal type.

More preferably, the impacts of the jets on a single face of the strip are distributed at the nodes of the two-dimensional network so as to form a complex polygonal mesh with a number of sides of between 3 and 20, with a periodicity equal to 1 pitch in the transverse direction of the strip and between 3 and 20 pitches in the longitudinal direction of the strip, in such a way that adjacent blow-jet impact traces are contiguous on one face of the strip in the transverse direction of said strip.

Preferably, the blowing modules are set in such a way that the network corresponding to one face and the network corresponding to the other face are offset from one another, the offset being between ¼ of a pitch and ¾ of a pitch.

The blowing axes of the nozzles may be perpendicular to the plane of travel of a strip.

The blowing axis of at least one nozzle forms an angle with the normal to the plane of travel of said strip.

The blowing ports of the nozzles may have a circular, polygonal, oblong or slot-shaped cross-section.

The blowing modules are of the type with gas uptake or without gas uptake.

Preferably, each blowing module consists of a distribution chamber on which the blowing nozzles are positioned.

The invention is applicable in particular to installations for the continuous treatment of thin metal strips such as steel or aluminium strips. These treatments are for example continuous annealing, or dip-coating treatments such as galvanisation or tinning. The invention makes it possible to achieve high heat exchange intensities with the strip without inducing unacceptable vibrations of the strip.

The invention will now be described more precisely but in a non-limiting manner with reference to the appended drawings, in which.

Figure 1:
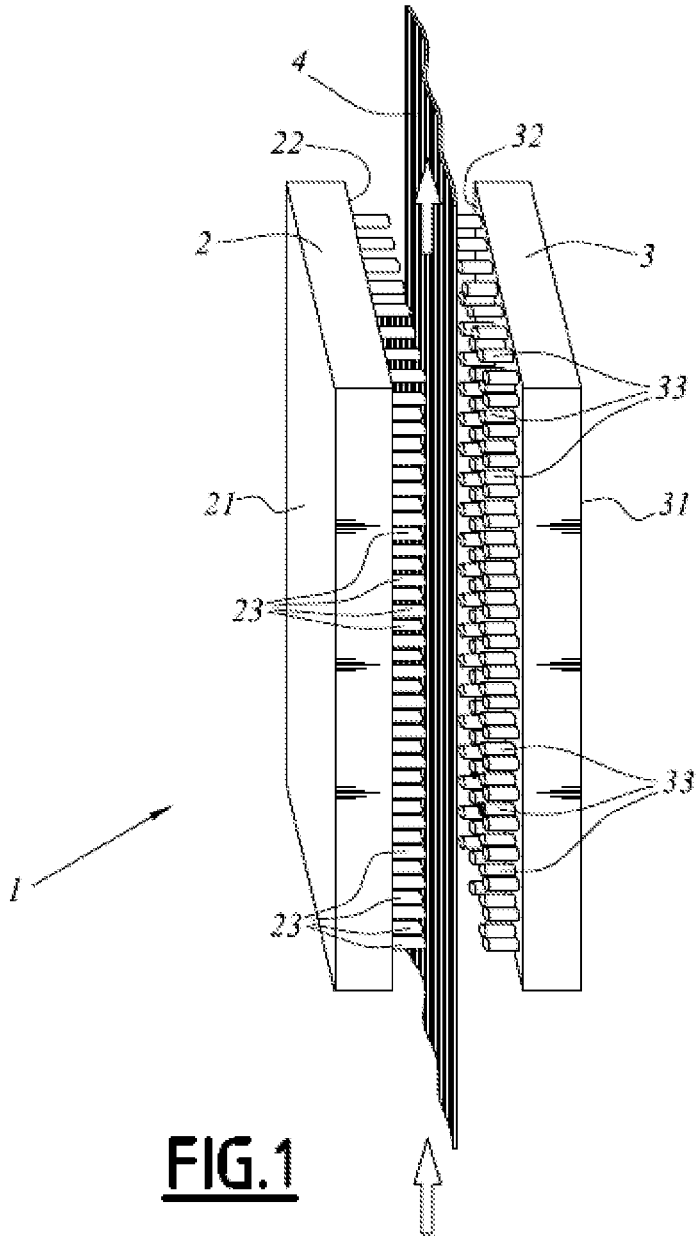
FIG. 1 is a schematic perspective view of a strip travelling in a module for cooling by gas-blowing.

The installation for cooling by blowing a gas, denoted generally as 1 in FIG. 1, consists of two blowing modules 2 and 3 arranged on either side of a travelling strip 4. Each blowing module consists of a distribution chamber 21 on one side and 31 on the other side, both supplied with pressurised gas.

Each of the distribution chambers is of a generally parallelepiped shape, one with a face 22 and the other with a face 32 of a generally rectangular shape, which faces are arranged opposite one another and on which faces a plurality of cylindrical blowing nozzles 23 in one case and 33 in the other case are provided. These cylindrical nozzles are tubes with a length which is approximately 100 mm and may be between 20 mm and 200 mm, preferably between 50 and 150 mm, and having an internal diameter which is for example 9.5 mm but may be between 4 mm and 60 mm. These tubes are distributed on the faces 22 and 32 of the distribution chambers in such a way that the impacts from the blow-jets for one face of the strip are distributed over a two-dimensional network which is preferably a periodic network of which the mesh may be square or diamond-shaped so as to constitute a distribution of the hexagonal type. The distance between two adjacent tubes is for example 50 mm, and may be between 40 mm and 100 mm. The number of nozzles on each face of a distribution chamber of a cooling module may be as many as a few hundred. The distance between the heads of the nozzles and the strip may be between 50 and 250 mm. To achieve such a distribution of the impacts of the jets on the strip, when the nozzles produce mutually parallel jets, the nozzles on each chamber are distributed in a two-dimensional network identical to the two-dimensional distribution network of the jet impacts on the strip. However, when the jets are not mutually parallel, the distribution of the nozzles on a chamber is different from the distribution of the impacts of the jets on the surface of the strip.

Figures 2, 3:
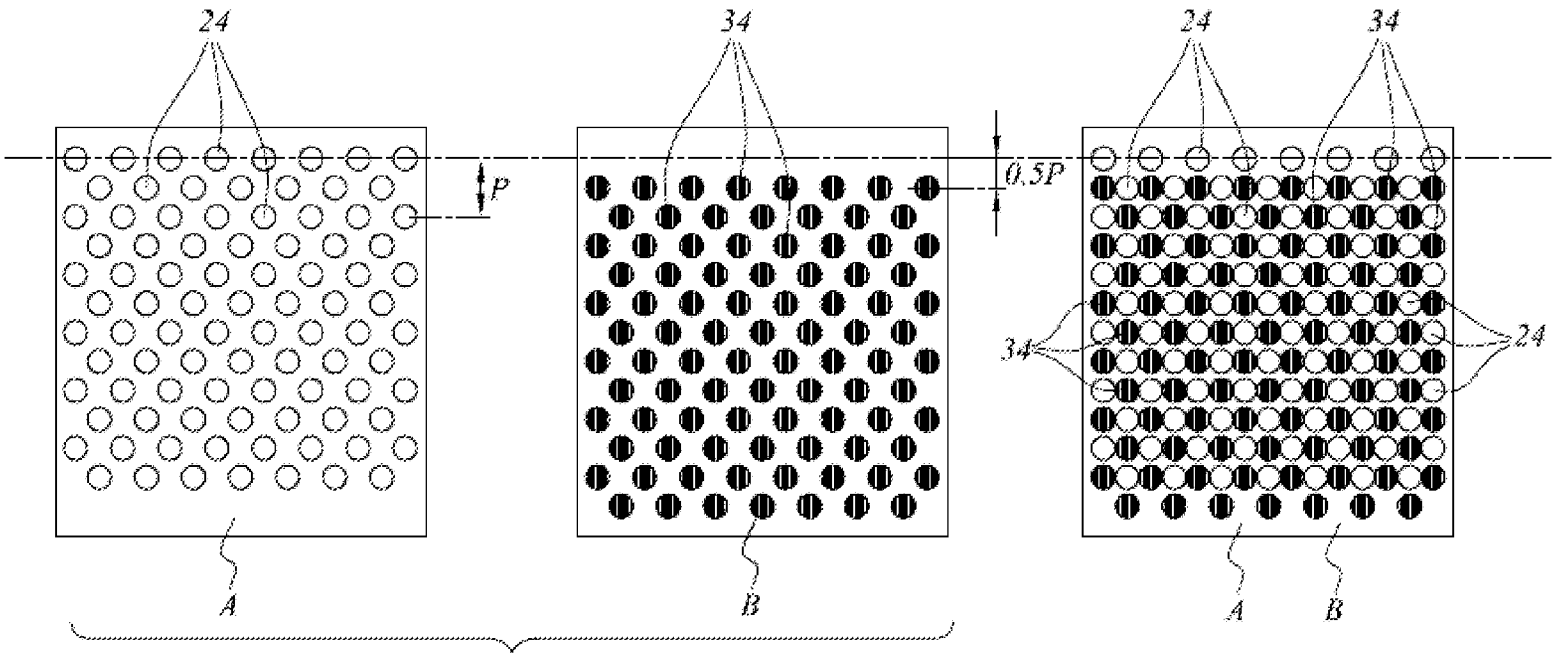
FIG. 2 is a view of the distribution of the impacts of gas jets on the blowing regions of a first face and the second face of a strip.
FIG. 3 shows the superposition of the distributions of the cooling jet impacts on the two faces of a single strip.

In the embodiment shown in FIG. 2, the tubes are distributed in such a way that the impacts 24 of the jets emitted by the blowing module 2 on the face A of the strip are distributed at the nodes of a two-dimensional network, which in the example shown is a periodic network of the hexagonal type of which the pitch p is shown. The blowing nozzles of the second blowing module 3 are distributed on the distribution chamber 31 in such a way that the impacts 34 of the gas jets on the face B of the strip are distributed evenly at the nodes of a periodic two-dimensional network also of the hexagonal type and with mesh also equal to p. The two two-dimensional networks corresponding in one case to the face A and in the other case to the face B are offset from one another in such a way that the impacts 34 of the gas jets of the face B are not opposite the impacts 24 of the gas jets of the face A, in such a way that these impacts are staggered.

The offset is set in such a way that the impacts of the jets on one face are opposite spaces left free between the impacts of the jets on the other face.

For this reason, as is shown in FIG. 3, in which the impacts of the jets on face A and the jets on face B are shown in a superimposed manner, a dense distribution of the set of impact points of the blow-jets is achieved on both faces.

Such a distribution of the impact points of the blow-jets for each of the faces of the strip has the advantage of better distributing the contacts between the blow-jets and the surfaces of the strip, and thus of providing more homogeneous cooling than if the jets are opposite one another. As a result, the heat exchange coefficient between the strip and the gas is improved. This distribution of the jets also has the advantage of reducing the stresses exerted on the surface of the strip. Furthermore, this distribution of the jets substantially reduces the vibrations of the strip and thus the lateral displacement and the torsion of the strip.

The inventors have found that to obtain a substantial reduction in the vibrations of the strip, the distribution of the impact points on the surface of the strip need not necessarily be in a two-dimensional network of the hexagonal type, and the offset between the two networks need not be equal to half a pitch.

In fact, what is essential is that on the one hand, the returning gas, i.e. the gas which has been blown against the strip and which needs to be removed, can escape by flowing between the nozzles both perpendicular and parallel to the direction of travel of the strip, and on the other hand, the impact points are not opposite one another, it being possible for the offset between the two networks to be for example between one quarter and three quarters of a pitch. This offset can be made in the direction of travel of the strip or in the direction perpendicular to the travel of the strip.

The inventors have also found that the nozzles for blowing gas may have cross-sections of various shapes. These may be for example blow-openings of a circular cross-section or a polygonal cross-section, such as squares or triangles for example, or else oblong shapes, or even in the form of short slots.

However, it is important that the blowing takes place via nozzles of the tubular type, the heads of which extend at a sufficiently great distance from the lateral faces of the distribution chambers to allow returning gas to be removed, by a flow which is both parallel to the direction of travel of the strip and perpendicular to the direction of travel of the strip. In fact, it is the combination of the good distribution of the removal of the gases and the distribution of the impact points of the gas jets on the surface of the strip which allows high stability to be obtained for the strip.

Figure 4:
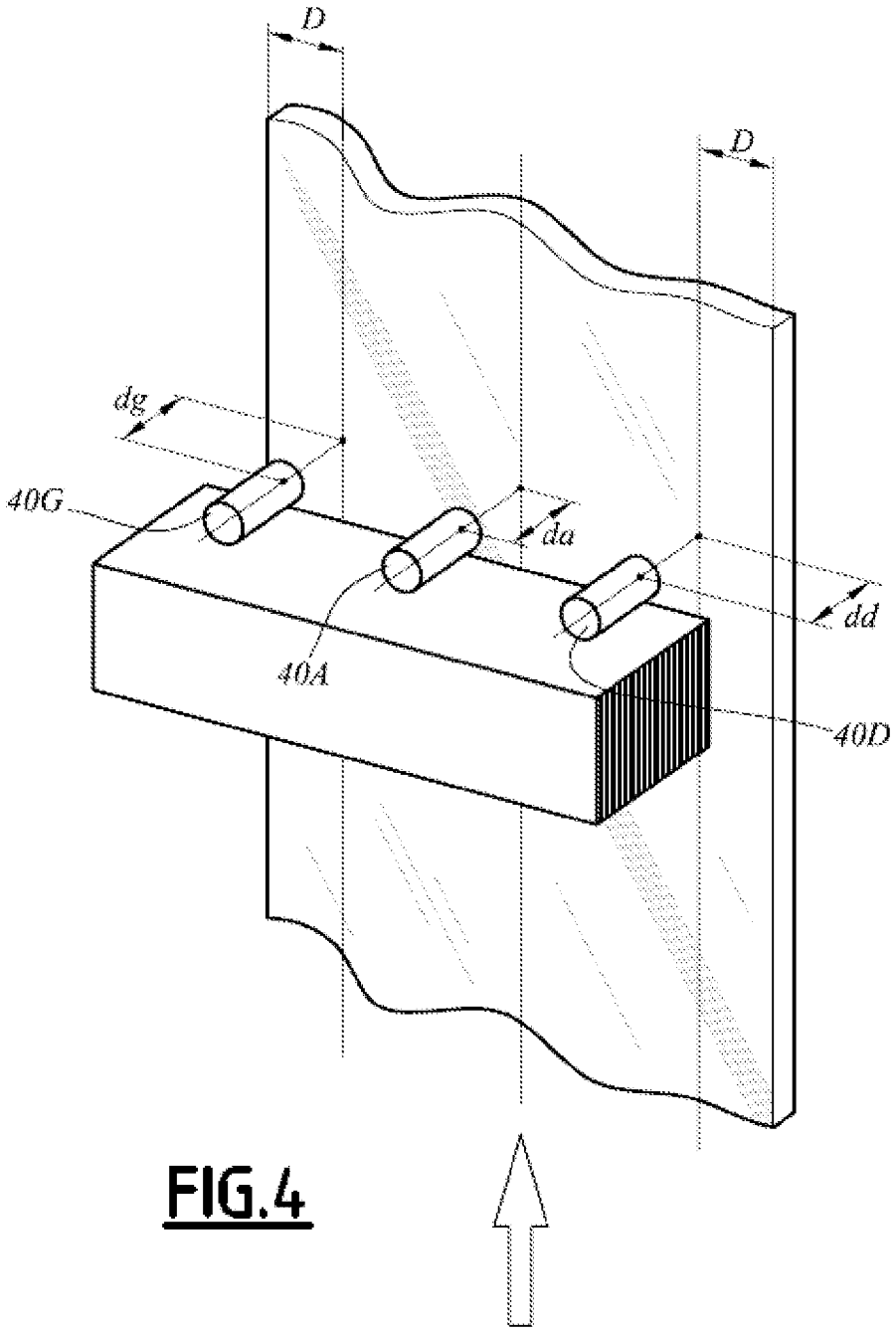
FIG. 4 is a schematic representation of the measurement of the lateral displacement of a strip in a cooling device.

By way of example, the vibratory behaviour of a strip travelling between two blowing modules of rectangular shape having a length of 2200 mm, provided with cylindrical tubes having a length of 100 mm and a diameter of 9.5 mm arranged in a network of the hexagonal type with a pitch of 50 mm, the two blowing modules being arranged opposite one another in such a way that the distance between the heads of the nozzles and the strip was 67 mm, were compared. A steel strip 950 mm wide and 0.25 mm thick was arranged under a constant tension between these two blowing modules. The supply pressure of the distribution chambers was varied between 0 and 10 kPa above atmospheric pressure, and the lateral displacement of the strip was measured with three lasers arranged in the direction of the width of the strip, as shown in FIG. 4, with a laser 40A arranged on the axis of the strip to measure the distance $d_a$ a laser 40G arranged to the left of the strip to measure the distance $d_g$ at a distance D of approximately 50 mm from the edge of the strip, and also a third laser 40D arranged to the right of the strip at a distance D of approximately 50 mm from the edge of the strip and measuring the distance $d_d$.

The distances $d_a$, $d_g$ and $d_d$ are the distances from a line parallel to the central plane of the zone of travel of the strip.

With these measurements, it is possible to determine the average displacement of the strip, equal to $\frac{1}{3}(d_g+d_a+d_d)$, and the torsion, which is equal to $|d_g-d_d|$ (absolute value of the difference between the lateral displacements).

To measure these two values, measurements are taken during blowing. For the lateral displacement, the average peak-to-peak distance between the lateral displacements is determined. For the torsion, the average amplitude of the torsion is measured.

Figure 6:
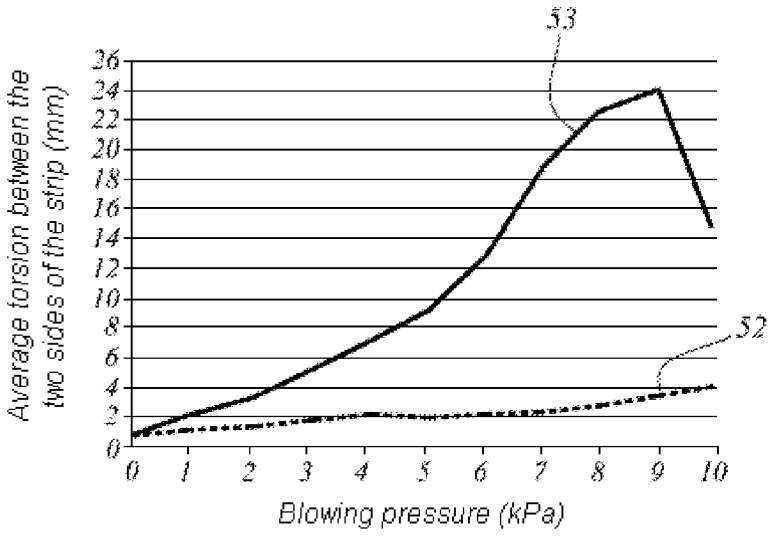
FIG. 6 shows the average torsion of a strip travelling in a device for cooling by blowing, as a function of the blowing pressure, both in the case where the blow-jets for the two faces are offset from one another and in the case where the blow-jets for the two faces are opposite one another.
Figure 5:
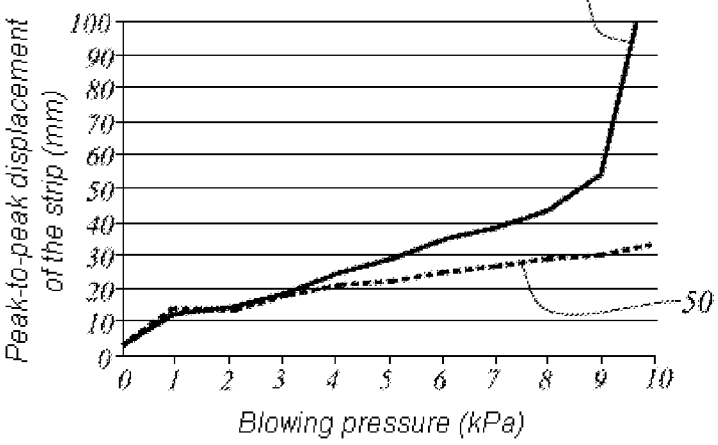
FIG. 5 shows the change in the lateral displacement of the strip in a device for cooling by blowing, both in the case where the blow-jets for one face and another face are offset from one another and in the case where the jets for the two faces are opposite one another.

FIGS. 5 and 6 show the lateral displacements on the one hand and the average torsions on the other hand for the cooling modules according to the invention, of which the gas jets are offset from one another (the gas jets on one face are offset from the gas jets on the other face), as well as for modules for cooling by blowing which are identical to the above modules but in which the blow-jets for one face are opposite the blow-jets for the opposite face.

As can be seen from FIG. 5, the curve 50, which relates to blowing modules according to the invention, shows a slow change in the peak-to-peak displacement amplitudes of the strip, which vary from approximately 15 mm for a blowing overpressure of 1 kPa to approximately 30 mm for a blowing overpressure of 10 kPa. In this same figure, the curve 51, which shows the change in the peak-to-peak displacement amplitude for blowing modules of which the blow-jets for one face are opposite the blow-jets for the other face, shows that the displacement amplitude of the strip for a blowing overpressure of approximately 1 kPa is still 15 mm, but that this amplitude increases more substantially than in the preceding case and reaches approximately 55 mm for a blowing pressure of 9 kPa then exceeds 100 mm for a blowing pressure of 10 kPa.

These curves show that with the device according to the invention, it is possible for the strip to travel between the two blowing modules spaced by a distance such that the distance between the heads of the nozzles and the strip is 67 mm, with blowing pressures which may be up to 10 kPa, whereas with blowing modules in which the blow-jets for one face are opposite the blow-jets for the other face, it is only possible to use these devices for blowing overpressures of substantially less than 9 kPa.

In the same way, the curve 52 of FIG. 6, which represents the change in the twisting or torsion as a function of the blowing pressure, shows that with the devices according to the invention, the twisting remains less than 4 mm even for blowing overpressures of up to 10 kPa. By contrast, with chambers of which the jets are not offset from one another, the twisting may be as much as 24 mm for blowing overpressures of 9 kPa.

To compare the behaviour of the strip when it is cooled using blowing modules according to the invention and blowing modules according to the prior art, in which the distribution chambers blow air through laterally extending slots, the displacement amplitude of the strip was measured as a function of the blowing overpressure, for distances between the heads of the blowing nozzles and the surface of the strip of 67 mm, 85 mm and 100 mm, both with blowing modules according to the invention and with blowing modules according to the prior art.

Figure 7:
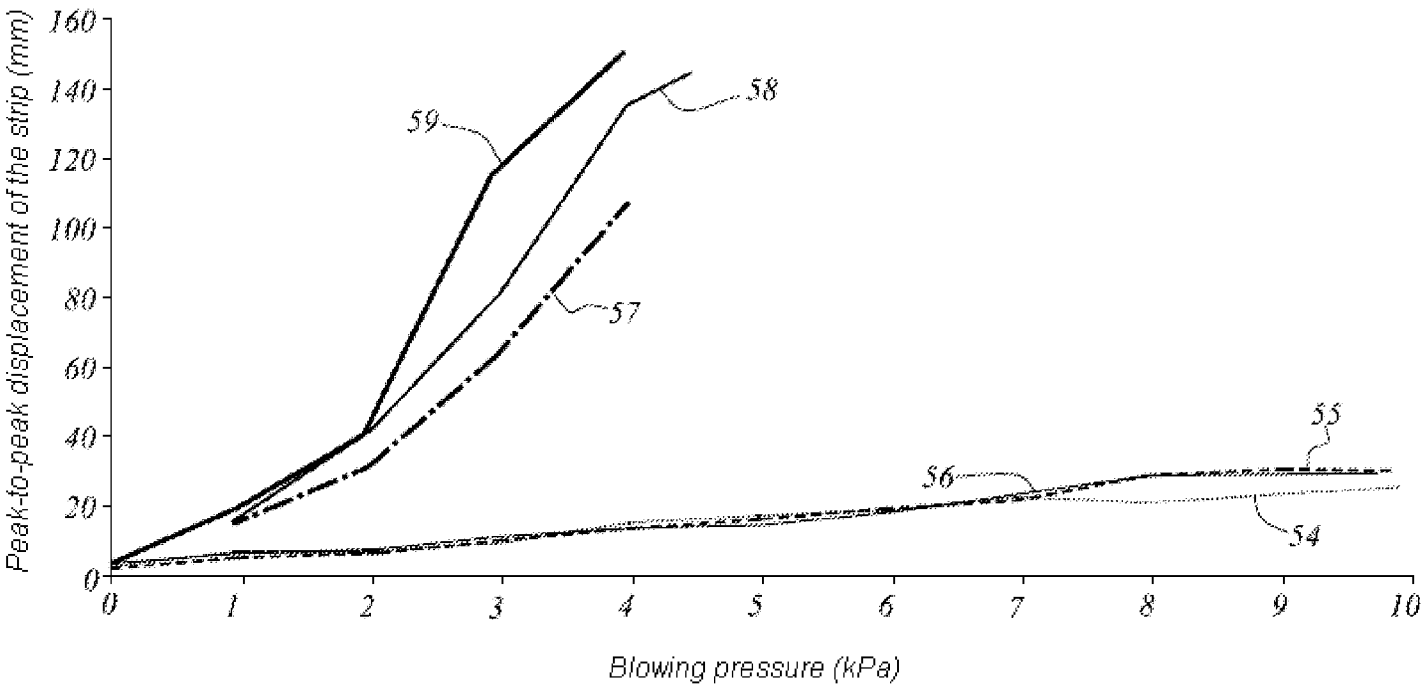
FIG. 7 shows the change in the lateral displacement of the strip in a device for cooling by blowing, both in the case where the strip is cooled by a blowing device according to the invention and in the case where the strip is cooled by a device which blows through slots according to the prior art.

These results are shown in FIG. 7, in which curves 54, 55, 56 relating to the strip cooled by a blowing device according to the invention for distances of 67 mm, 85 mm and 100 mm respectively are in effect superimposed and show that for blowing overpressures which may be as much as 10 kPa, the displacement amplitudes remain less than 30 mm.

The curves 57, 58, 59 relating to the strip cooled using devices according to the prior art, which blow gas through slots extending over the width of the strip, correspond to distances of 67 mm, 85 mm and 100 mm respectively between the blowing nozzles and the strip. These curves show that for blowing pressures of up to 4 kPa, the displacement of the strip, exceeds 100 mm and may be as much as 150 mm.

Figure 8:
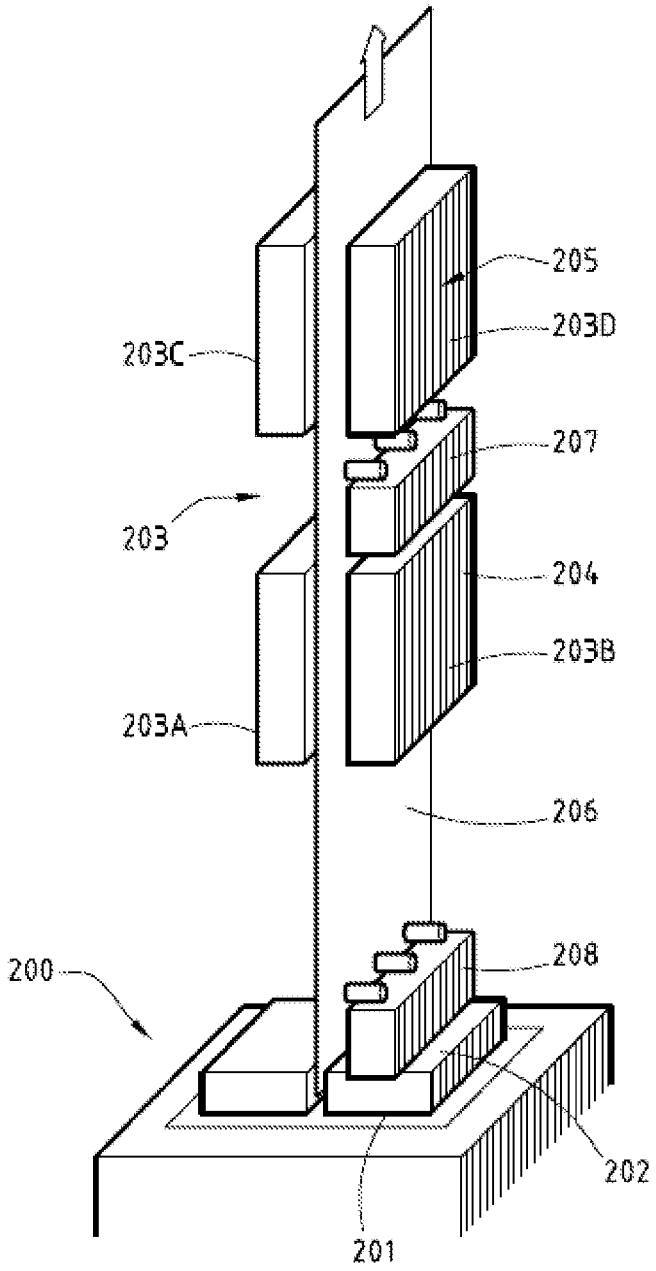
FIG. 8 is a schematic representation of the outlet of a dip-coating installation comprising a cooling device.

The vibratory behaviour of a strip travelling in the industrial dip-coating installation in a bath of molten metal denoted generally as 200 in FIG. 8, comprising a drying module 202 at the outlet of the bath 201, and a cooling module, denoted generally as 203, downstream from the cooling module has also been characterised. This cooling module comprises four blowing modules 203A, 203B, 203C and 203D, of a rectangular shape with a length of approximately 6500 mm and a width of 1600 mm. Each blowing module is provided with cylindrical nozzles having a length of 100 mm and a diameter of 9.5 mm arranged in a network of the hexagonal type with a pitch of 60 mm. The four blowing modules are arranged so as to form two blocks 204 and 205 of two modules 203A, 203B and 203C, 203D respectively, arranged opposite one another on either side of a zone of travel of a strip 206. The distance between the heads of the nozzles and the strip is 100 mm. Furthermore, to perform the tests described below, on the one hand a first means for measuring the lateral displacements of the strip 207 between the two blocks 204 and 205 of blowing modules was arranged approximately 13 meters downstream from the blowing module, and on the other hand a second means for measuring the lateral displacements of the strip 208 was arranged at the outlet of the drying module 202. The two measurement means are of the same type as that which is shown in FIG. 4. However, whereas the first measurement means 207 arranged at the blowing modules comprises lasers, the second measurement module 208 arranged at the outlet of the drying module comprises inductive sensors.

To perform the tests, a steel strip of thickness 0.27 mm, which had a high temperature of approximately 400° C. at the outlet of the bath and which had to have a temperature of less than 250° C. at the outlet of the cooling module, was passed through. The strip was passed through at a constant speed and the blowing pressure was varied. Furthermore, tests were performed on the one hand with blowing modules according to the invention, i.e. with nozzles arranged in such a way that the impacts of the jets on one face of the strip are not opposite the impacts of the jets on the other face of the strip, and on the other hand with chambers according to the prior art, i.e. with the impacts of the jets on one face being opposite the impacts of the jets on the other face.

A first series of measurements of the displacement of the strip was performed using the first measurement means 207 arranged between the two blocks of blowing modules. For this purpose, the supply pressure of the blowing modules was varied and the displacement of the strip was measured using three lasers arranged in the direction of the width of the travelling strip.

A second series of measurements of the displacement of the strip was also performed upstream from the cooling module in the direction of travel of the strip and downstream from the drying module, at a distance of a few centimeters from said drying module. This second series of measurements was performed using the second measurement means 208.

To obtain these two series of measurements, results are taken during drying, in identical production conditions for the tests relating to the prior art and to the invention. To measure the lateral displacement of the strip, the average peak-to-peak amplitude of the lateral displacements of the strip was determined.

Figure 9:
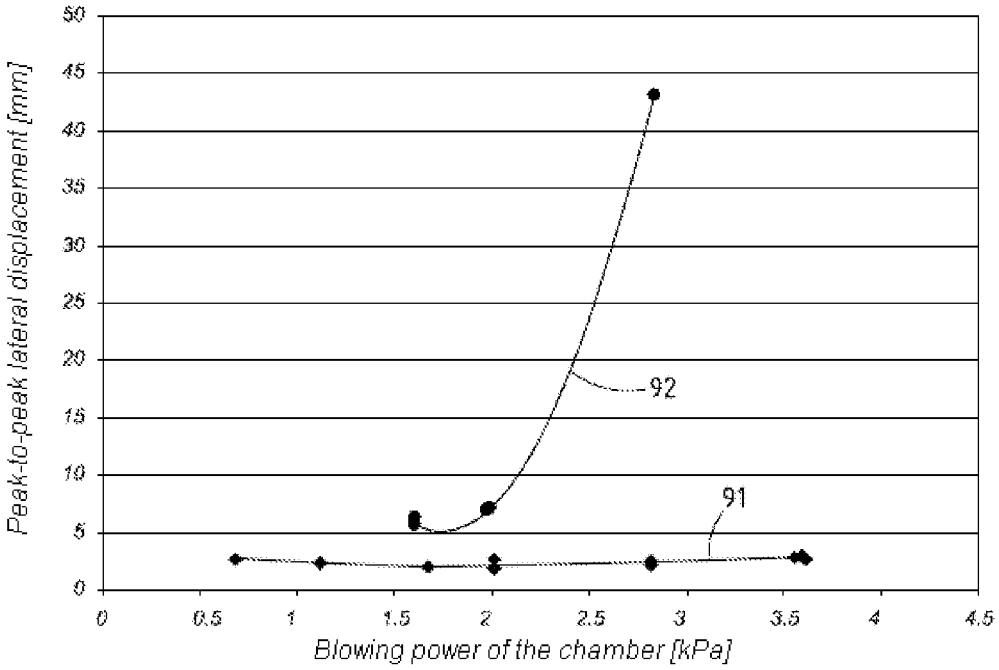
FIG. 9 shows the change in the lateral displacement of the strip cooled in a device for cooling by blowing in the dip-coating installation of FIG. 8, measured at the drying module, both in the case where the blow-jets for one face and another face are offset from one another and in the case where the blow-jets for the two faces are opposite one another.

FIG. 9 shows the results of the first series of measurements, i.e. the lateral displacements of the strip (peak-to-peak distance), as a function of the blowing power, taken at the blowing module. The curve 91 relating to a cooling module 203 according to the invention shows that the peak-to-peak displacement amplitudes of the strip are approximately constant. The displacement amplitudes oscillate around 2 to 3 mm for a blowing overpressure varying from 0.7 kPa to 4 kPa.

The curve 92 shows the change in the peak-to-peak displacement amplitudes for a cooling module according to the prior art. This curve 92 shows that the displacement amplitudes of the strip for a blowing overpressure varying from 1.5 kPa to 2.7 kPa increase exponentially. These deformations limit the cooling capacities of the device and consequently the productivity of the production process. In fact, it has been found that the deformations lead to a degradation in the quality of the product if they are too great, and this leads to a limitation of the blowing pressures to at most approximately 2.5 kPa.

If the deformations of the strip at the blowing modules are too great, degradation of the product is also observed at the drying module, upstream from the cooling module. In fact, the vibrations are propagated along the strip from the blowing modules to the drying modules, and can lead to quality defects in the product. The second series of measurements taken at the drying module makes it possible to evaluate the repercussions at the drying module of the strip vibrations induced at the blowing module.

Figure 10:
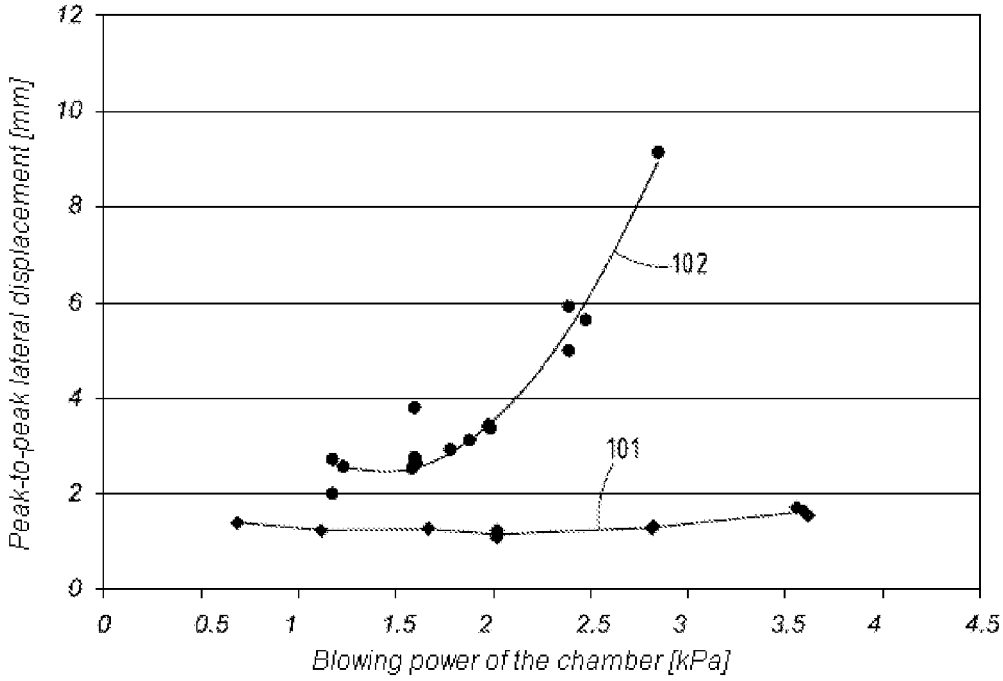
FIG. 10 shows the change in the lateral displacement of the cooled strip in a device for cooling by blowing in the dip-coating installation of FIG. 8, measured at the cooling module, both in the case where the blow-jets for one face and another face are offset from one another and in the case where the blow-jets for the two faces are opposite one another.

FIG. 10 shows the results of the second series of measurements. The curve 102 shows the peak-to-peak displacement amplitudes in the case of the device according to the prior art. For a blowing pressure varying from 1.2 to 3.0 kPa, the displacement amplitudes at the drying module increase exponentially from approximately 2.5 mm to approximately 9 mm, until they lead to deterioration of the product. This effect of the high blowing pressures on the amplitude of the deformations of the strip makes it necessary to limit the blowing power substantially to less than 2.8 kPa.

In this same figure, the curve 101 relating to the cooling device according to the invention remains substantially horizontal, below 1.8 mm, for a blowing pressure varying from 0.5 kPa to 3.5 kPa.

These results show that with blowing modules according to the invention, the lateral displacement amplitudes of the strip are reduced considerably, and this reduction may be so great that they are divided by a factor of 5.

Furthermore, the inventors noted that the strip was no longer placed under torsion with the device according to the invention, both at the cooling module and at the drying module, irrespective of the power of the cooling jets.

Figure 11:
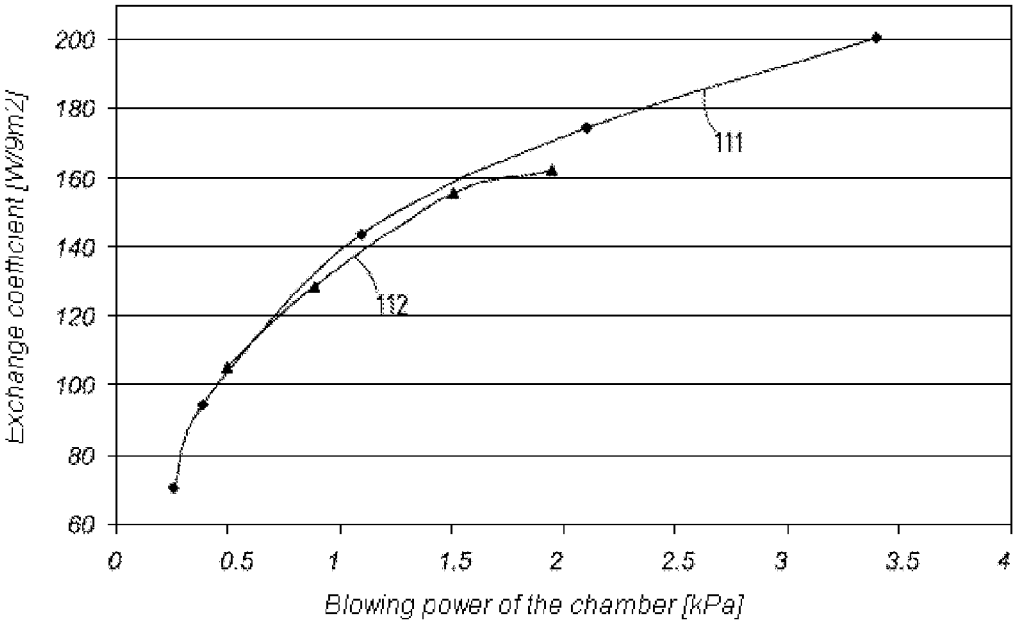
FIG. 11 shows the change in the heat exchange coefficient as a function of the blowing power of the blowing modules, in a device for cooling by blowing as in FIG. 8, both in accordance with the invention, the blow-jets for one face and another face being offset from one another, and in a cooling device according to the prior art, the blow-jets from the two faces being opposite one another.

FIG. 11 also shows the change in the heat exchange coefficient as a function of the blowing pressure of the blowing modules so that the cooling performance of the cooling devices according to the invention can be compared with those of cooling devices according to the prior art. In this figure, curve 111 corresponds to the invention and curve 112 to the prior art. The two curves become progressively greater and show that the cooling power increases with the blowing pressure. However, the curve according to the prior art stops at a blowing pressure of 2.0 kPa because, beyond this, the vibrations cause the product to deteriorate. The maximum cooling power is therefore 160 $W/m^2.°$ C. The curve according to the invention, on the other hand, extends for blowing pressures of up to 3.5 kPa, allowing a cooling power of 200 $W/m^2.°$ C. to be achieved. The invention thus allows the heat extraction power of the travelling strip to be increased very substantially.

These results show that, by using a device according to the invention, it is possible to cool the strip with relatively high blowing pressures while having very limited vibrations of the strip.

The reader will appreciate that the numerical values given above for the ranges of use of the cooling module correspond to particular test conditions and, in particular, to the thickness, the width and the speed of travel of the strip.

In the example just described, the blowing jets are directed perpendicularly to the surface of the strip, but it may be advantageous to incline all or some of the blowing jets to the normal to the strip. In particular, it may be beneficial to orient the gas jets situated at the edges of the strip toward the exterior of the strip. It may also be beneficial to orientate all or some of the jets in the direction of travel of the strip or, on the other hand, opposite the direction of travel of the strip, so as to force the removal of the blown gas or of the gas/water mixture after impact on the strip and thus to promote heat exchange.

It will also be noted that the blowing gas, which is a pure gas or a mixture of gases, can be air or a mixture consisting of nitrogen and hydrogen or any other mixture of gases. This gas can be at a temperature lower than the temperature of the strip. The blowing is thus used to cool the strip. This is the case, for example, when a strip issues from hot galvanisation or an annealing treatment.

However, the blown gas can be a hot gas and, in particular, can be a combustion gas from a burner and may be intended for the preheating of a strip before it is introduced into a heat treatment installation.

The nozzles may all be arranged on one and the same generally planar distribution chamber or may be distributed over a plurality of distribution chambers, these distribution chambers being, for example, tubes extending over the width of the strip.

If the distribution chambers are tubes, they can also be oriented parallel to the direction of travel of the strip.

It is therefore possible, with the invention, to very substantially reduce the strip vibrations induced in the region of the distribution chambers, to very substantially reduce the strip vibrations in the region of the drying module, to substantially increase the cooling powers of the distribution chambers, to guarantee very high quality of the product and consequently to substantially increase the productivity of the method of production.

In a preferred embodiment of the invention, the blowing nozzles are arranged on distribution chambers in such a way that the impacts of the blowing jets overlap on one face of the strip in the transverse direction of said strip.

This arrangement in which the impacts of blowing jets on one face of the strip are not opposite to the impacts of jets on the other face of the strip, but in which the impacts of the jets on each of the faces of the strip overlap has the advantage of preventing the formation of defects on the strip known as jet lines in the direction of travel of the strip and parallel to one another in the transverse direction of the strip.

If the impacts of the gas jets are disposed in such a way that they form lines of jets, these lines of jets are manifested by oxidation trails when a strip is heated by blowing a hot gas such as hot air. When cooling a strip which is coated by hot dipping in a molten metal bath, they are manifested on the strip by a succession of coating lines having a different surface appearance. In the case of the galvanisation of a strip, for example, the strip issuing from the cooling treatment in a cooling device which does not comprise an overlap of the impact jets on a single face of the strip, exhibits a succession of lines having a glossy surface appearance and lines having a mat surface appearance.

To prevent the formation of these jet lines, the nozzles can be arranged in such a way that the impacts of the jets on a face of a strip are distributed over a plurality of lines each extending over the width of the strip, each line comprising a plurality of impacts of given diameter d and distributed uniformly by a pitch p, the impacts of two successive lines or of two successive groups of lines being offset laterally in such a way that the lines of jets resulting from the different lines lead to lines of jets which cover the entire width of the strip.

Figure 12:
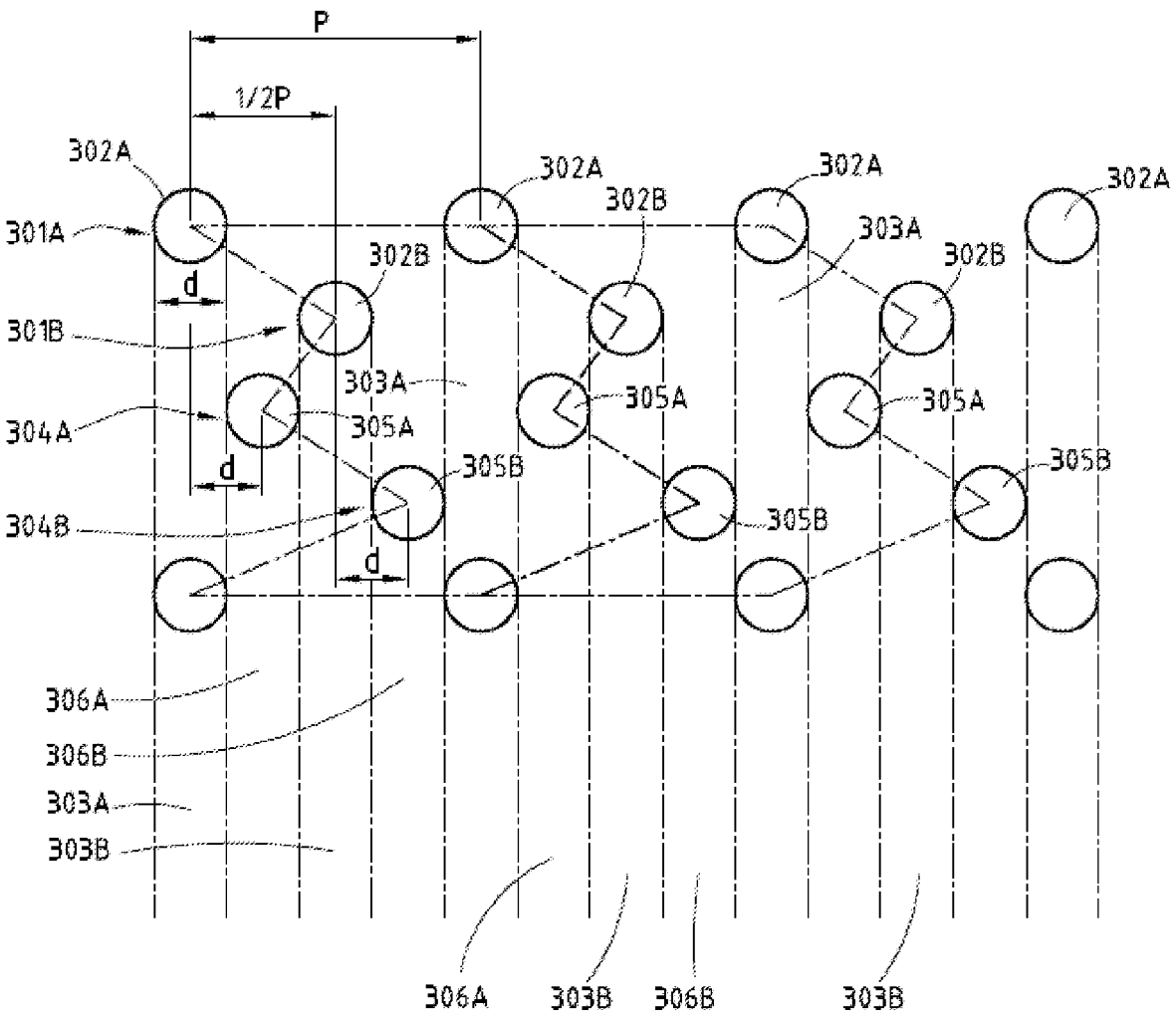
FIG. 12 shows a distribution of the impacts of the gas jets on one face of a travelling strip providing uniform blowing on the surface of the strip.

FIG. 12 shows an example of distribution of the impacts which results in good uniformity of the actions of the jets on the entire surface of the strip.

This figure shows a portion of the network formed by the impacts of the jets on a face of a strip 300. This network is formed by a pattern consisting of four lines of impacts which can be divided into two groups: a first group consisting of two lines of impacts 301A and 301B, and a second group of lines of impacts 304A and 304B. Each line 301A, 301B, 304A and 304B consists of impacts 302A, 302B, 305A and 305B, respectively, which are uniformly distributed with a pitch p. In each of the groups, the second line 301B or 304B is deduced from the first line 301A or 301B respectively, on the one hand by lateral translation by half a pitch, that is p/2, and on the other hand by a longitudinal translation by a length l. In addition, the second group of lines consisting of lines 305A and 305B is deduced from the first group of lines 301A and 301B by a lateral translation by a distance d equal to the diameter d of an impact. With this arrangement, the traces left by the impacts on the strip 303A, 303B in the case of the impacts 302A and 302B, and 306A, 306B in the case of the impacts 305A and 305B, form strips which are connected once the diameter of an impact is at least equal to one quarter of the pitch p separating two adjacent impacts on a single line. If the number of impacts is to be increased, the network can be extended by reproducing the distribution of the impacts which has just been described by translation by a length equal to four times the distance l separating two successive lines. A periodic network of which the mesh is a complex polygon is thus obtained.

In the example just described, four lines of impacts are used to provide good coverage of the strip with the traces of the impacts. However, the person skilled in the art will appreciate that other arrangements are possible. In particular, good surface coverage of the strip can be achieved if the impacts of the jets from the blowing nozzles on a single face of the strip are distributed at the nodes of a two-dimensional network so as to form a complex polygonal mesh with a number of sides of between 3 and 20, with a periodicity equal to one pitch in the transverse direction of the strip and between 3 and 20 pitches in the longitudinal direction of the strip. This distribution must be set while allowing, in particular, for the width of an impact of a jet from a blowing nozzle. A person skilled in the art knows how to make such an adaptation.

With distributions of impacts of this type, the inventors have found that the defect of jet lines disappears in the case of cooling modules according to the invention.

The invention claimed is:

1. A device for acting on the temperature of a travelling strip, the device comprising:

at least two blowing modules arranged opposite one another on either side of a zone of travel of the strip, each blowing module consisting of a plurality of tubular nozzles extending from at least one distribution chamber in the direction of the zone of travel of the strip, the nozzles being arranged in such a way that the impacts of jets from the tubular nozzles on each face of the strip are distributed at the nodes of a two-dimensional network, wherein, in order to reduce the vibrations of the strip which are induced by the blowing of gas or a gas/water mixture, the heads of the tubular nozzles extend at a distance from the distribution chamber in such a way as to leave a free space for the flow of the returning gas or water/gas mixture parallel to the longitudinal direction of the strip and perpendicular to the longitudinal direction of the strip, and the blowing modules are set in such a way that the jet impacts on one face of the strip are not opposite the jet impacts on the other face of the strip.

2. The device according to claim 1, wherein the two-dimensional networks in which the jet impacts are distributed are periodic networks based on the same pattern and with the same pitch.

3. The device according to claim 2, wherein the pattern of the network is hexagonal.

4. The device according to claim 1, wherein the impacts of the jets on a single face of the strip are distributed at the nodes of the two-dimensional network so as to form a complex polygonal mesh with a number of sides varying from 3 to 20, with a periodicity equal to 1 pitch in the transverse direction of the strip and between 3 and 20 pitches in the longitudinal direction of the strip, in such a way that adjacent blow-jet impact traces are contiguous on one face of the strip in the transverse direction of said strip.

5. The device according to claim 2, wherein the blowing modules are set in such a way that the network corresponding to one face and the network corresponding to the other face are offset from one another, the offset being between ¼ of a pitch and ¾ of a pitch.

6. The device according to claim 1, wherein the blowing axes of the nozzles are perpendicular to the plane of travel of said strip.

7. The device according to claim 1, wherein the blowing axis of at least one nozzle forms a non-zero angle with the normal to the plane of travel of said strip.

8. The device according to claim 1, wherein the blowing ports of the nozzles have a circular, polygonal, oblong or slot-shaped cross-section.

9. The device according to claim 1, wherein the blowing modules are of the type with gas uptake.

10. The device according to claim 1, wherein each blowing module consists of a distribution chamber on which the blowing nozzles are positioned.

11. The device according to claim 1, wherein the length of the nozzles is between 20 and 200 mm.

12. The device according to claim 1, wherein the device is a device for cooling a travelling strip.

13. The device according to claim 1, wherein the blowing modules are of the type without gas uptake.

14. The device according to claim 1, wherein at least one distribution chamber is of a parallelepiped shape.

15. The device according to claim 1, wherein in at least one distribution chamber, the blowing nozzles extend from a flat surface of said distribution chamber.

16. The device according to claim 1, wherein on each side of the zone of travel of the strip, the blowing nozzles are arranged on plurality of distribution chambers.

17. The device according to claim 16, wherein at least one distribution chamber is a tube.

18. The device according to claim 1, wherein no stabilizing rollers are used.

19. The device according to claim 1, wherein the device is a device for heating a travelling strip.

* * * * *